US006648554B1

(12) United States Patent
Sehl

(10) Patent No.: US 6,648,554 B1
(45) Date of Patent: Nov. 18, 2003

(54) PORTABLE FLOTATION PLATFORM FOR SHALLOW BODIES OF WATER

(76) Inventor: James Francis Sehl, R.R. 2 Box 119, St. James, MN (US) 56081

( * ) Notice: Subject to any disclaimer, the term of this patent is extended or adjusted under 35 U.S.C. 154(b) by 0 days.

(21) Appl. No.: 10/191,245

(22) Filed: Jul. 9, 2002

(51) Int. Cl.[7] ..... B63B 35/00; B63C 1/00

(52) U.S. Cl. ..... 405/219; 405/203; 405/218; 441/35; 114/45; 114/351

(58) Field of Search ..... 405/1, 3, 4, 196, 405/198, 203, 204, 205, 218, 219, 229; 114/45, 357, 263–265, 351–353; 5/706, 709; 441/35, 45

(56) References Cited

U.S. PATENT DOCUMENTS

| | | | | | |
|---|---|---|---|---|---|
| 3,107,496 | A | * | 10/1963 | Suderow | 405/203 |
| 4,070,980 | A | * | 1/1978 | Shorter, Jr. | 114/263 |
| 4,099,656 | A | * | 7/1978 | Neumann et al. | 294/157 |
| 4,465,009 | A | * | 8/1984 | Wood et al. | 114/61.33 |
| 4,497,591 | A | * | 2/1985 | Gillis | 405/198 |
| 4,599,835 | A | * | 7/1986 | Rinke | 52/169.7 |
| 4,799,445 | A | * | 1/1989 | Meriwether | 114/263 |
| 4,825,799 | A | * | 5/1989 | Bergeron et al. | 114/351 |
| 4,938,629 | A | * | 7/1990 | Boudrias | 405/205 |
| 5,188,484 | A | * | 2/1993 | White | 405/205 |
| 5,239,940 | A | * | 8/1993 | Griffin | 114/353 |
| 5,588,782 | A | * | 12/1996 | Haring | 114/263 |
| 5,787,836 | A | * | 8/1998 | Blaisdell et al. | 114/357 |
| 6,089,936 | A | * | 7/2000 | Hoffman | 441/117 |
| 6,230,644 | B1 | * | 5/2001 | Passen et al. | 114/263 |
| 6,273,016 | B1 | * | 8/2001 | Gibbs | 405/1 |
| 6,374,763 | B1 | * | 4/2002 | Hartman | 114/263 |
| 6,461,081 | B2 | * | 10/2002 | Legleux | 114/265 |
| 6,475,594 | B2 | * | 11/2002 | Johnston et al. | 428/100 |

FOREIGN PATENT DOCUMENTS

| | | | | |
|---|---|---|---|---|
| GB | 2175257 | * | 11/1986 | 405/196 |
| JP | 62291314 | * | 12/1987 | 405/196 |
| WO | 9208849 | * | 5/1992 | 405/203 |

* cited by examiner

*Primary Examiner*—Jong-Suk (James) Lee

(57) ABSTRACT

A portable flotation platform is disclosed for use in supporting a load of equipment or hunting dogs above the level of a shallow body of water. The platform includes a deck constructed to be of an overall density less than that of water and sized so as to support the load above the level of the water. An anchor extends down to the bottom of the water and up to the deck to hold the deck on station in the water. The deck is provided with a carrying attachment to facilitate the user carrying the deck to the point of deployment on the water.

18 Claims, 3 Drawing Sheets

PORTABLE FLOTATION PLATFORM FOR SHALLOW BODIES OF WATER

BACKGROUND OF THE INVENTION

This invention relates to portable flotation platforms, and more particularly to platforms adapted to be deployed in shallow bodies of water for supporting loads, such as equipment and hunting dogs, above the level of the body of water.

Duck hunters hunting in wetland areas having shallow bodies of water typically rely on dogs to retrieve the fowl that they down. When the hunter is in a boat, the dogs can stand-by in the boat with the hunter, but this is often not desirable and a better place for the dogs at the hunt is needed. When the bodies of water are shallow enough to allow the hunter to stand but not for the dogs to do so, the dogs must stand-by on firm ground, which is not always available nearby, or the dogs must keep themselves afloat in the water which is exhausting and perhaps even dangerous to the dogs. Again a better place for the dogs to stand-by is needed.

Similarly, fishermen, environmentalists and park personnel frequenting wetlands with shallow bodies of water need to support their respective equipment above the level of the water. In some areas, the use of a boat, even a small boat or canoe, is not practical because of the shallow depth of the water or because excessive portage of the boat would be required. In a manner similar to hunters seeking a better place for their dogs on trips to the wetlands, these users of the wetlands seek a better place for their equipment.

SUMMARY OF THE INVENTION

Among the features of the invention is the provision of a portable flotation platform which may be carried by the user to and from the wetlands site of use. Another feature is the provision of a platform for the support of a load of equipment or hunting dogs above the water level in a generally stationary position.

More particularly, a portable flotation platform is disclosed for supporting a load of equipment or hunting dogs above the level of a shallow body of water. The platform includes a deck constructed to be of an overall density less than that of water and presenting a rigid upper member for carrying the load above the water level. An anchor is provided as part of the platform which when deployed engages the bottom of the body of water to hold against movement across the bottom and extends up toward the surface of the water. The deck has at least one connector for detachably securing the deck to the anchor to prevent horizontal movement of the deck across the water. A carrying attachment is provided on the deck for enabling a user to carry the platform to and from a point of deployment in the body of water, preferably in a manner similar to a back pack.

Among other features of the invention are an anti-skid upper surface to prevent movement of the load across the deck, an interior storage chamber in the deck for housing the anchor when not in use, an adjustable length anchor to accommodate bodies of water of differing depths and a stop detachably secured on the anchor to limit upward movement of the deck, such as might otherwise occur with wave action on the body of water.

Other features and advantages will be in part described and in part apparent from the following figures and descriptions.

BRIEF DESCRIPTION OF THE DRAWINGS

Corresponding elements and reference numbers are the same among the various figures of the invention.

DETAILED DESCRIPTION OF AN EXEMPLARY EMBODIMENT

Figure 1:
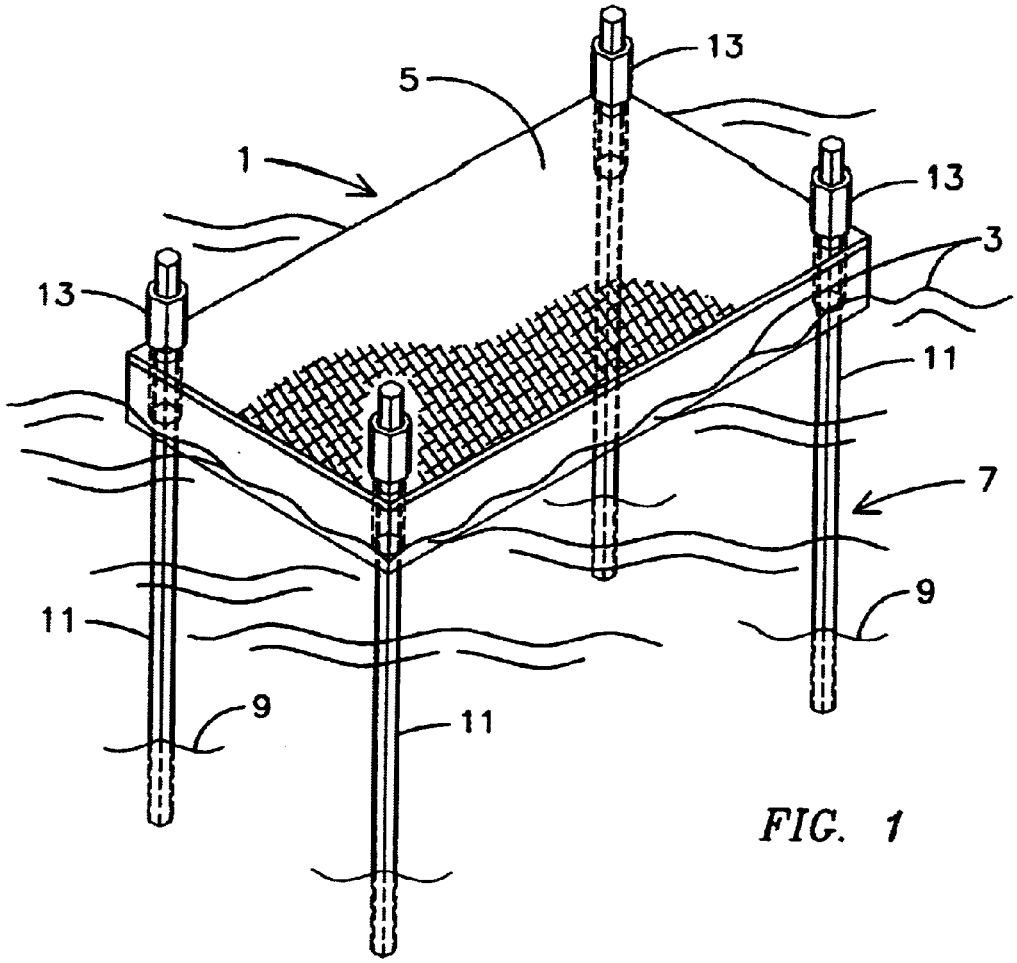
FIG. 1 is a perspective view of the platform of this invention as deployed in a body of water, but with certain components removed from this view for greater clarity of the relationship of the deck and anchor to the body of water.

Referring to FIG. 1 of the drawings there is generally indicated at 1 a preferred embodiment of this invention for supporting a load of equipment or hunting dogs (not shown) above the level of a shallow body of water 3. Hunting dogs often accompany hunters on a hunting trip to wetlands or lakes having one or more shallow bodies of water. When the water is so shallow that a hunter can stand on the bottom, the water may still be too deep to enable the dogs to do so. The platform 1, when deployed as shown in FIG. 1, provides a suitable structure for supporting the dogs slightly above the water level. As described hereinafter, the platform may be installed in relatively deep bodies of water (i.e., too deep for a hunter to stand and thus requiring a boat for the hunters) and yet provide a suitable structure to support the hunting dogs.

The equipment positioned on the platform may include not only hunting and fishing equipment, but also water quality monitoring equipment for environmentalists and state agencies. Indeed, as described hereinafter, the platform is sized so and so constructed that it may support any number of different types of live or dead loads, up to weights of approximately between 70 to 100 pounds. Further, as also described in detail herein, the platform may be carried by users on their backs, like a backpack, to and from a point of deployment at the body of water, and be readily deployed on site.

As shown in FIG. 1, the platform comprises a deck 5 constructed to be of an overall density less that that of water so as to float on the water, and an anchor indicated generally of suitable design, such as indicated generally at 7, engagable with the bottom 9 of the body of water and the deck for holding the deck on station in the water against horizontal movement. The preferred anchor is shown as comprising poles 11 extending down into the bottom 9 of the body of water and up above the surface of water 5. Four poles are shown as being provided, one at each corner of the deck, but a greater or lesser number of poles may be provided and be positioned at other points of the deck, while remaining within the scope of this invention. Stops 13 may be detachably secured to the poles 11 at desired locations on the poles to prevent upward movement of the deck 5 beyond the stops. Thus, the deck may be held down by the stops some distance below the level that the deck would otherwise occupy in the water 3 to bias the deck up against the stops, and thus hold the deck stable against vertical movement when waves on the surface of the water hit the platform.

Figure 2:
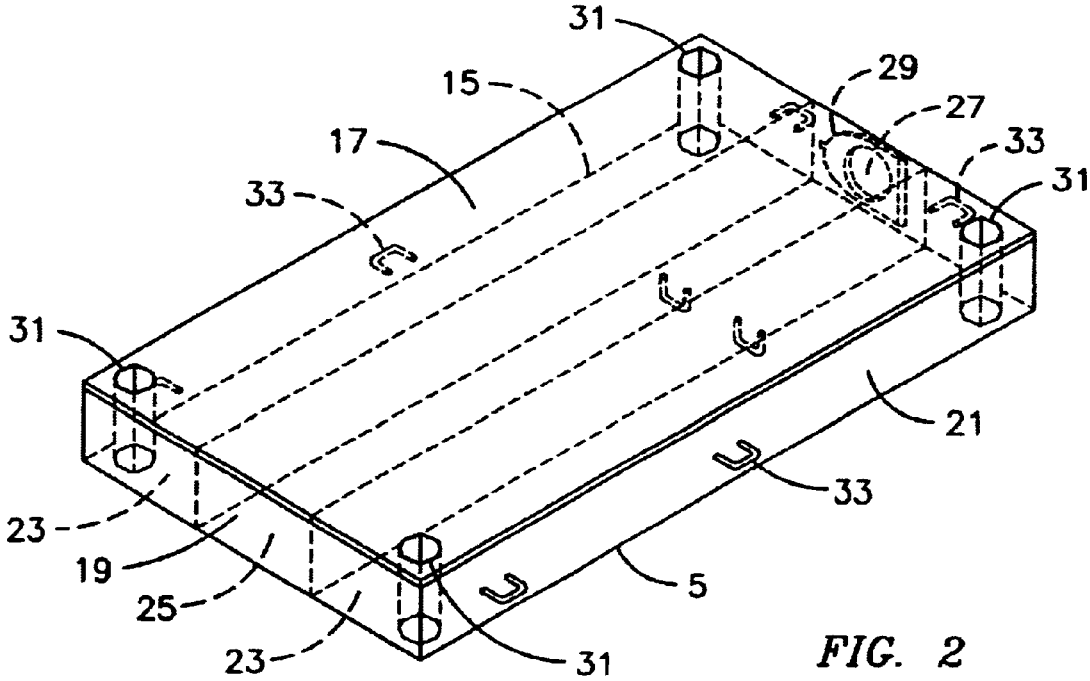
FIG. 2 is a perspective view of the deck with certain components removed from this view for greater clarity of the interior construction details of the deck.

As best illustrated in FIG. 2, the deck 5 is of generally box-like construction having a bottom 15, an upper member 17, as well as opposed ends 19 and sides 21 extending between the bottom and upper member. These members are formed of pieces of suitable thermoplastic sheets and are secured together along their edges by suitable primary or secondary bonding. In its interior, the deck has at least one buoyancy chamber 23 (and as shown in FIG. 2, two such buoyancy chambers) filled with a suitable plastic foam material, such as Styrofoam, to reduce the effective density of the deck. The deck also preferably has an interior storage chamber 25 for housing the anchor poles 11 when not in use to facilitate transporting the poles with the deck. The chamber 25 extends the length of the deck and is sized to receive all of the poles. An opening 27 in the end of the deck at the chamber provides access to the chamber for positioning the poles in and withdrawing the poles from the chamber. A cap 29 with a hinge to the end 19 of the deck and a latch selectively closes the opening to hold the poles in place in the chamber during transit as well as to keep water out while the deck is in use.

Suitable anchor connectors 31 to the anchor poles 11 are provided on the deck, such as short lengths of plastic tubing secured to each of the four corners of the deck. The openings or apertures of the connectors 31 are sized to receive the anchor tubes 11 in sliding engagement to enable the anchor to hold the deck on station against horizontal movement while enabling vertical movement of the deck up and down on the anchor tubes with changes in water level. Attached at the exterior of the deck are a series of generally U-shaped brackets 33 for attachment of back-pack type carrying straps 35, and a decoy bag 37 as more fully described below.

Overall the size of the deck is preferably approximately 36" long, 20" wide, and 4' thick and weights approximately 18 pounds, including the anchor poles. So constructed, the deck may be carried, preferably like a back-pack, to the site of use. Once the platform 1 is deployed, the deck 5 provides sufficient size to able equipment or a dog to remain stable on the upper surface, and sufficient buoyancy to support this load.

Figure 3:
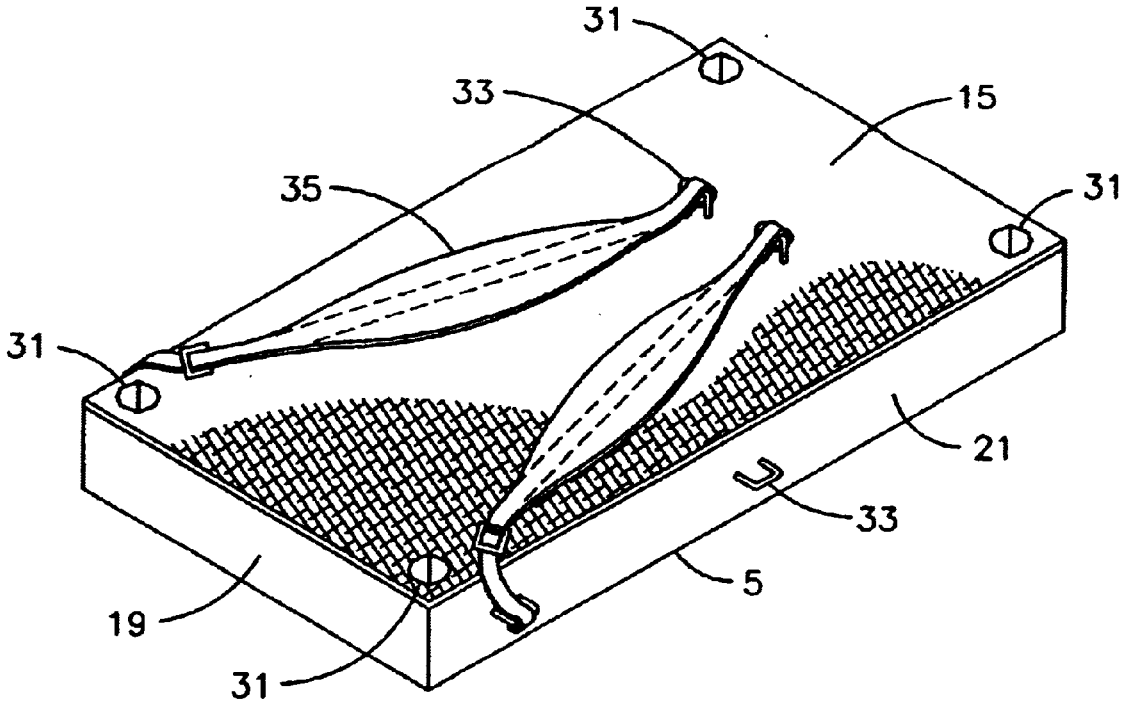
FIG. 3 is a perspective view of the bottom of the deck with carrying straps attached.

FIG. 3 shows the bottom 15 of the deck, with a carrying attachment in the form of two carrying straps 35 at opposite sides of the bottom. Each strap is secured at its lower end to a bracket 33 at the side 21 of the deck and at its upper end to a bracket 33 at a generally central region of the bottom of the deck. A fastener on the carrying strap enables adjustment of the effective length of the strap between its upper and lower ends to fit the size of the user. The straps may also include clasps (not shown) detachably securing the straps to the deck for enabling easy removal of the straps from the deck, such as when the platform is deployed.

Figure 4:
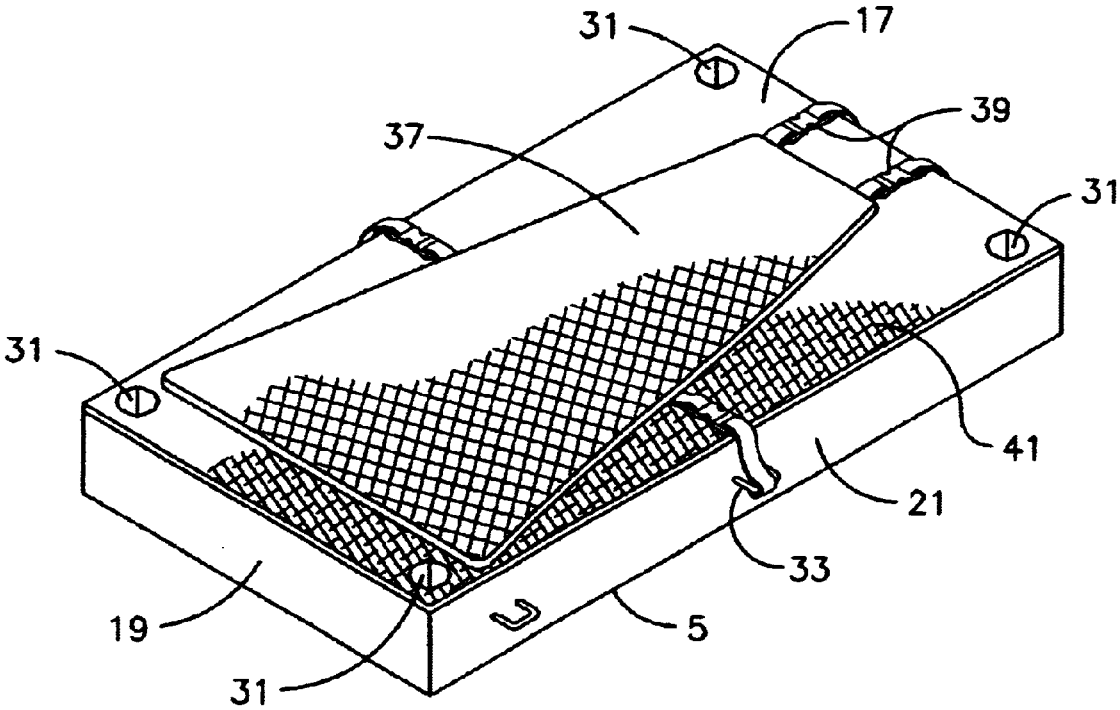
FIG. 4 is a perspective view of the top or upper member of the deck with a decoy bag attached.

FIG. 4 shows the upper member 17 of the deck, with a decoy bag 37 detachably secured over the upper surface. The decoy bag is preferably of mesh construction and is attached by a series of straps to brackets 33 at the sides and an end of the deck. Clasps 39 are provided on each strap to enable removal of the decoy bag when the deck is deployed, thereby exposing the surface of the upper member. This surface is preferably of a suitable anti-skid construction, such as outdoor carpeting 41 bonded to the upper member, to prevent the unintended movement of the load (such as that of a dog or equipment) across the deck.

Figure 5:
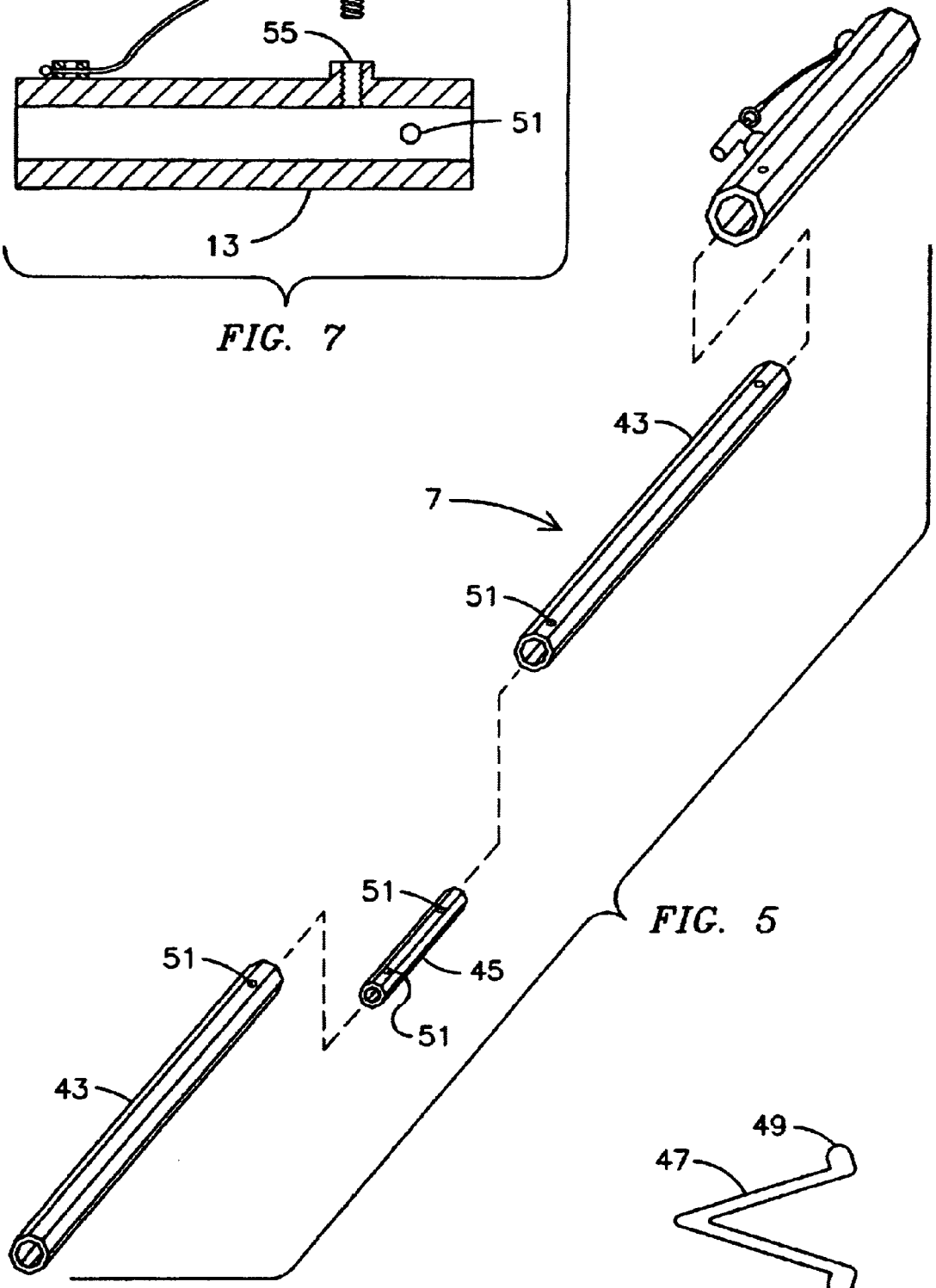
FIG. 5 is an exploded view of an anchor pole showing two pole segments and a connector to be telescoped between the segments.

As shown in FIG. 5, the anchor 7 preferably comprises a pole of extensible length, which in turn comprises one or more pole segments 43 detachably secured together. More particularly, the pole segments are formed of a suitable tubing such as aluminum tubing slightly shorter than the length of the deck 5. The pole segments are detachably secured together by a connector 45, such as a short length of tubing, telescoped within one end of the pole segment. The tubing connector 45 is positioned wholly within the pole segment 43 when not in use to connect pole segments to facilitate positioning the pole segments in the deck anchor storage chamber 25.

Figure 6:
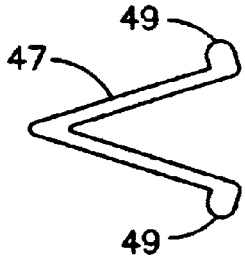
FIG. 6 is a side view of a spring clip forming part of the anchor pole connector for detachably securing the pole segments together.

To connect the pole segments, the tubing connector is moved to a position extending approximately one half of its length beyond the end of the tubing segment. A suitable fastener is provided at each end of the tubing connector, such as the spring clip 47 shown in FIG. 6 received in the connector. Each spring clip has a pair of arms biased outwardly to a position wider than the tubing connector and has a lateral projection 49 at the end of each arm. The tubing and the pole segments have holes 51 extending there through that register when the pole segments are connected end-to-end over the tubing connector 45. In this position, the projections 49 on the spring clip are moved out under the spring bias through the corresponding holes 51 to secure the pole segments together. Preferably, the pole segments are of non-circular section, such as octagonal as shown in FIG. 5, to facilitate bringing the holes and spring clips into register. Disassembly of the pole segments can be effected by manually depressing the projections 49 on the spring clips, such as by finger pressure, while applying force to pull the post segments 43 away from each other.

Figure 7:
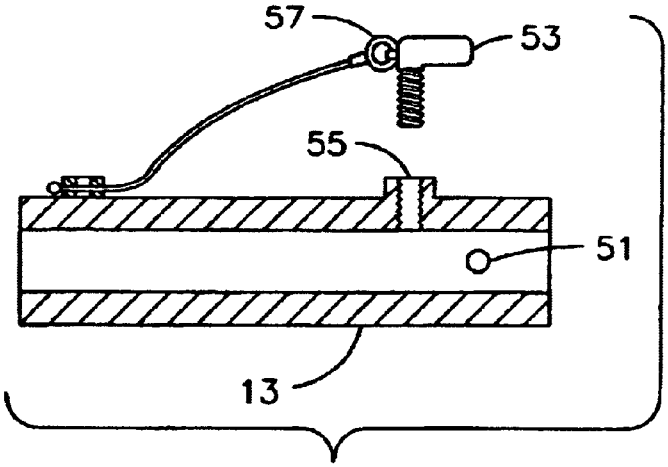
FIG. 7 is a longitudinal section of a stop to be positioned on an anchor pole.

As shown in FIGS. 5 and 7, the stop 13 is constructed of tubing of generally the same sectional shape as the anchor poles 11, but of slightly larger size than the anchor poles 11 and the apertures in the anchor connectors, so to act as a collar in sliding engagement along the pole and as a point of contact with the deck to limit upward movement of the deck. The stop has a fastener, such as the L-shaped bolt 53 threaded into a threaded bore 55 opening to the interior of the stop. The bolt when threaded into the bore projects into engagements with the pole segment to set the collar in the desired position on the anchor pole. A tether 57 secured at one end thereof to the bolt 53 holds the bolt attached to the stop at times when the bolt is not threaded in the bore, such as during storage of the anchor poles. Similarly, the stop may be provided with a hole and the pole provided with a spring clip 47 to hold the stop on the tubing during storage.

In the use of the platform 1 of this invention, the deck, with the anchor poles 11 in the storage chamber and the decoy bag 37 preferably attached, is carried by the user by boat or on his back using the carry straps 35 to the point of deployment of the platform in the wetlands or shallow lakes. The user then removes the anchor poles from the deck. If the water depth requires that the anchor poles be of extended length, a suitable number of segments are assembled together by use of the tubing connectors 45. The anchor poles are then positioned in the body of water 3 so as to extend down through one or more of the anchor connectors 31 in the deck and penetrate the bottom 9 of the body of water. Stops 13 may then be positioned on the anchor poles and set in position by means of bolt 53 to engage the deck and hold it partially depressed in the water to make the deck more stable in a vertical direction. With the platform thus deployed as shown in FIG. 1, a load of equipment or a dog may be supported on the deck. Disassembly of the platform 1 for transport away from the site of deployment may be effected by reversing the steps described above.

It will be understood that one skilled in the art may make modifications of the preferred embodiment shown herein within the scope and intent of the claims of this application. While the present invention has been described in terms of a specific embodiment thereof, it is not intended the present invention should be limited thereby, but is intended to cover the invention broadly within the scope and spirit of the claims.

What is claimed is:

1. A portable flotation platform to be carried by a user to a point of deployment at a shallow body of water, and as deployed in the water to support a load above the level of the body of water, the platform comprising:

a deck constructed to be of an overall density less than that of water, so that when deployed the deck floats on the body of water, with the deck presenting a rigid upper member for carrying the load above the water level;

an anchor which when deployed engages the bottom of the body of water, holds against movement across the bottom, and extends up toward the surface of the water;

the deck having at least one connector for detachably securing the deck to the anchor to prevent horizontal movement of the deck across the water; and a carrying attachment comprising a pair of straps for enabling a user to carry the deck supported on the user's body to and from a point of deployment at the body of water.

2. The flotation platform of claim 1 wherein the deck is of rigid, generally box-like construction having a bottom, sides and ends extending up from the bottom to the upper member.

3. The flotation platform of claim 2 wherein the pair of straps are secured to the deck at opposite sides of the deck, with each strap being secured at its upper and lower ends to the deck.

4. The flotation platform of claim 3 wherein each strap includes a fastener for enabling adjustment of the length of the strap extending between its ends.

5. The flotation platform of claim 2 wherein the upper member of the deck includes a skid resistant surface to prevent movement of the load across the deck.

6. The flotation platform of claim 2 wherein the deck includes at least one flotation chamber therein.

7. The flotation device of claim 2 wherein the deck is constructed of plastic material to form the bottom, sides, ends and upper member of the deck.

8. The flotation device of claim 7 wherein the plastic is a thermoplastic material.

9. The flotation device of claim 1 wherein the anchor is an elongate pole of rigid material, which when deployed penetrates the bottom of the body of water.

10. The flotation device of claim 9 wherein the connector on the deck includes an aperture on the deck for receiving the upper end of the pole.

11. The flotation device of claim 10 wherein the anchor comprises four poles, and the deck includes four apertures, one at each corner of the deck.

12. The flotation device of claim 9 wherein the pole is extendable in length so as to be deployed in bodies of water of differing depths.

13. The flotation device of claim 9 wherein the pole comprises multiple segments detachably secured together to adjust its length.

14. The flotation device of claim 9 further comprising a stop adjacent the upper end of the pole at the deck for limiting upward motion of the deck relative to the anchor.

15. The flotation device of claim 14 wherein the stop comprises a collar detachably secured at desired positions along the length of the pole above the deck and engageable with the deck to prevent movement of the deck up past the collar.

16. A portable flotation platform for supporting a load of equipment or hunting dogs above the level of a shallow body of water, the platform comprising:

a deck constructed to be of an overall density less than that of water, so that when deployed the deck floats on the body of water, with the deck presenting a rigid upper member for carrying the load above the water level;

an anchor which when deployed engages the bottom of the body of water, holds against movement across the bottom, and extends up toward the surface of the water;

the deck having at least one connector for detachably securing the deck to the anchor to prevent horizontal movement of the deck across the water; and a carrying attachment on the deck for enabling a user to carry the deck to and from a point of deployment at the body of water;

wherein the deck is of rigid, generally box-like construction having a bottom, sides and ends extending up from the bottom to the upper member, includes at least one flotation chamber therein housing a plastic foam material and at least one storage chamber for holding the anchor when not in use.

17. A portable flotation platform for supporting a load of equipment or hunting dogs above the level of a shallow body of water, the platform comprising:

a deck constructed to be of an overall density less than that of water, so that when deployed the deck floats on the body of water, with the deck presenting a rigid upper member for carrying the load above the water level, with the deck being of rigid, generally box-like construction having a bottom, sides and ends extending up from the bottom to the upper member;

an anchor which when deployed engages the bottom of the body of water, holds against movement across the bottom, and extends up toward the surface of the water;

the deck having at least one connector for detachably securing the deck to the anchor to prevent horizontal movement of the deck across the water;

a carrying attachment on the deck for enabling a user to carry the deck to and from a point of deployment at the body of water, and a bag detachably secured to the deck.

18. The flotation platform of claim 17 wherein the bag is detachably secured to the deck by a plurality of straps with clasps.

* * * * *